US010407853B1

(12) United States Patent
Dunn et al.

(10) Patent No.: US 10,407,853 B1
(45) Date of Patent: Sep. 10, 2019

(54) WRONG-WAY VEHICLE PREVENTION SYSTEM

(71) Applicants: Peter G Dunn, Peoria, AZ (US); Robert E Kohnen, Paradise Valley, AZ (US); David A Schuff, Surprise, AZ (US)

(72) Inventors: Peter G Dunn, Peoria, AZ (US); Robert E Kohnen, Paradise Valley, AZ (US); David A Schuff, Surprise, AZ (US)

( * ) Notice: Subject to any disclaimer, the term of this patent is extended or adjusted under 35 U.S.C. 154(b) by 0 days.

(21) Appl. No.: 16/006,948

(22) Filed: Jun. 13, 2018

Related U.S. Application Data

(60) Provisional application No. 62/520,153, filed on Jun. 15, 2017.

(51) Int. Cl.
*E01F 13/12* (2006.01)

(52) U.S. Cl.
CPC ..... *E01F 13/123* (2013.01); *E01F 13/12* (2013.01)

(58) Field of Classification Search
CPC ..... E01F 13/12; E01F 13/123
USPC ..... 404/6, 72
See application file for complete search history.

(56) References Cited

U.S. PATENT DOCUMENTS 2,627,920 A * 2/1953 Barlow ..... G07F 17/244 188/32
3,295,255 A * 1/1967 Russo ..... E01F 13/105 188/32
3,325,782 A 6/1967 Der
3,636,638 A 1/1972 Noyes
3,748,782 A 7/1973 Reynolds
3,787,558 A 1/1974 Keator
3,838,391 A 9/1974 Mintz
3,876,973 A 4/1975 Griebel
4,097,170 A 6/1978 Dickinson
4,133,140 A 1/1979 Berard et al.
4,158,514 A 6/1979 Dickinson
4,320,380 A 3/1982 Berard et al.
5,146,710 A * 9/1992 Caldwell ..... E01F 13/08 404/6

(Continued)

FOREIGN PATENT DOCUMENTS

FR 2879793 A 6/2006
NL 9401749 A 6/1996

*Primary Examiner* — Raymond W Addie
(74) *Attorney, Agent, or Firm* — Invention To Patent Services; Alex Hobson

(57) ABSTRACT

A wrong-way vehicle prevention system utilizes a sensor to detect a wrong-way vehicle traveling in a wrong direction on an off-ramp, and activates a disabling portion having a tire-rupture apparatus that ruptures one or more tires of the wrong-way vehicle. An alert portion having a sign, alert lights and/or an audible alert feature may be activated when a wrong-way vehicle is detected and the wrong-way vehicle may stop and turn around before driving over the tire rupture apparatus. The tire rupture apparatus has a rupture plate that extend substantially across the off-ramp and pivots up to raise a rupture portion above the surface of the off-ramp. The rupture portion has a sharp edge that will rupture a tire. The wrong-way vehicle system may alert authorities when a wrong-way vehicle is detected. The wrong-way vehicle prevention system may utilize an integral power supply to enable locating the system in remote areas.

20 Claims, 10 Drawing Sheets

(56) References Cited

U.S. PATENT DOCUMENTS

| | | | | |
|---|---|---|---|---|
| 5,890,832 | A * | 4/1999 | Soleau | E01F 13/123 256/1 |
| 6,045,293 | A | 4/2000 | Dickinson | |
| 6,241,418 | B1 * | 6/2001 | Suzuki | E01F 13/085 404/6 |
| 6,398,452 | B1 * | 6/2002 | Wagner | E01F 13/08 404/6 |
| 6,702,512 | B1 * | 3/2004 | Reale | E01F 13/123 404/6 |
| 7,001,099 | B2 * | 2/2006 | Rittenhouse | E01F 13/08 404/6 |
| 7,048,467 | B2 * | 5/2006 | Burns | E01F 13/046 404/6 |
| 7,441,982 | B1 * | 10/2008 | Al-Sabah | E01F 13/105 404/6 |
| 9,105,188 | B2 | 8/2015 | Alshinnawi et al. | |
| 2010/0178104 | A1 * | 7/2010 | Bare | E01F 13/12 404/6 |
| 2015/0252540 | A1 * | 9/2015 | Lee | E01F 13/123 404/6 |
| 2016/0343251 | A1 * | 11/2016 | Lee | G08G 1/04 |

* cited by examiner

WRONG-WAY VEHICLE PREVENTION SYSTEM

BACKGROUND OF THE INVENTION

Field of the Invention

This application claims the benefit of U.S. provisional patent application No. 62/520,153, filed on Jun. 15, 2017; the entirety of which is hereby incorporated by reference herein.

FIELD OF THE INVENTION

The invention relates to a wrong-way vehicle prevention system that incorporates a sensor and a tire puncture apparatus.

BACKGROUND

Wrong-way vehicles are becoming an ever-increasing problem on roadways, resulting in horrific accidents and fatalities and long road closures. In 2016, some 16000 wrong-way driver incidents were reported in Arizona alone. Distracted driving may be part of the problem, wherein drivers are operating electronic devices, such as cellphones while driving. Impairment may be another cause of wrong-way drivers including intoxication or driving while under the influence of drugs, exhaustion and the like. The United States population is aging and senility may be another cause of wrong way drivers. Many drivers quickly recognize their error when pulling the wrong way onto an off-ramp. Many off-ramps have signs posted that state "WRONG WAY" and this prevents most drivers from continuing down the ramp and onto the highway in the wrong direction. However, those that are impaired or confused may continue down the off-ramp and onto the highway. Accidents caused by wrong way drivers are almost always fatal due to the high rate of impact speed.

SUMMARY OF THE INVENTION

The invention is directed to a wrong-way vehicle prevention system that senses when vehicle is proceeding in wrong direction down an off-ramp and disables the vehicle by rupturing one or more of the vehicle's tires with a tire puncture apparatus. A wrong-way vehicle will be disable when all one or more, and preferably two or more and even more preferably when all four tires are punctured or ruptured, thereby preventing the vehicle from traveling up the highway in the wrong direction at a high rate of speed. Ideally, the vehicle will stop upon the rupture of the tires and authorities can then quickly remove the vehicle to prevent any traffic disruption or accidents.

An exemplary wrong-way vehicle prevention system may also comprise an alert portion that includes a sign, an alert light or lights and/or an audible alert feature, such as speaker than emits a siren or horn to get the drivers attention. An alert portion may also comprise systems and features to alert authorities that a wrong-way vehicle has been detected. An alert may be sent to authorities, such as the police or emergency responders, with information about the location and time of a wrong-way vehicle being detected. The authorities may dispatch personnel to the location and may initiate warnings, such as signs along the highway of the detected incident. For example, highway signs may be initiated on the highway approaching the wrong-way vehicle detection location that a wrong-way vehicle has been detected. An authority alert feature may comprise a camera that may be configured on the alert portion and may take an image of the wrong-way vehicle, the driver of the wrong-way vehicle and/or the license plate of the wrong-way vehicle. An image taken by this camera may be sent to the authorities to enable the authorities to locate the wrong-way vehicle. In some cases, the wrong-way vehicle may stop and turn around prior to driving over the tire rupture apparatus but may be impaired and an image of the vehicle may enable authorities to more easily apprehend the driver of the wrong-way vehicle. Likewise, some new vehicles have an identification that can be read wirelessly. An alert portion may comprise a scanner to detect the vehicle's unique identification code and this information may be sent to authorities. The authority alert notice may be sent wirelessly to an authority, such as a police and/or fire department or dispatcher and may include the image as described and/or the location of the wrong way driver or road name or offramp number and also the time.

An exemplary alert portion may be configured proximal to the disabling portion and may all be mounted to a single support, such as a post. This may enable easy installation of the wrong-way vehicle prevention system. In addition, a power supply for the wrong-way vehicle prevention system may be an integral power supply, or a power supply that requires no connection to a power grid, and may be a solar power generator, a wind power generator, a generator, a fuel cell, a battery, a combination thereof and the like. An integral power supply enables a wrong-way vehicle prevention system to be located in remote areas, wherein connection to a power grid is not possible. An exemplary alert portion of the wrong-way vehicle prevention system may have be located proximal to the disabling portion, such as within about 10 ft, within about 20 ft, within about 30 ft and any range between and including the distance provided. The close proximity of the alert portion, enables easy installation of the wrong-way vehicle prevention system. An alert portion may be configured on a single support, such as a post and may be powered by remote power supply such as a solar power generator incorporating photovoltaic cells. The entire alert portion may be configured on the support, including the power supply and battery. The sensor may also be configured on the support or post.

An exemplary sensor detects an approaching vehicle moving in a wrong-direction down an off-ramp. An exemplary sensor may be proximity sensor that sends out a source signal that bounces off of objects and returns to a detector. Changes in the speed of return of the signal can indicate the presence of a vehicle and direction of motion of the vehicle. An exemplary sensor may utilize microwaves for detecting a vehicle moving in a wrong direction. An exemplary sensor is coupled with a controller that activates other features of the wrong-way vehicle prevention system as a result of the wrong-way vehicle being detected. The controller may activate an alert feature and send an activation signal to the disabling portion when a wrong-way vehicle is detected. An exemplary sensor may detect, wirelessly, a unique identifier of a vehicle, such as an RFID tag, and as described herein, this identification may be sent to authorities. A wrong-way vehicle prevention system may comprise a plurality of different types of sensors.

The controller may comprise a microprocessor that may be integral with the sensor or may be a separate controller. A controller may send an activation signal through a physical connection line or by a wireless signal, sent by a wireless signal transmitter. In addition, a controller may send a signal to active other alert features including, but not limited to, signs, alert light(s) or an audible alert feature. For example, a sign may be posted on an alert portion of the wrong-way vehicle prevention system and lights may be configured to flash around the sign when a wrong-way vehicle is detected. Likewise, an audible alert feature including a speaker may produce a siren or horn when a wrong-way vehicle is detected. A wrong-way drive may see these alerts and stop the vehicle before driving over the tire rupture apparatus. In addition, other alerts may be activated when a wrong-way vehicle is detected including signs and alert lights posted along the highway to alert motorist of a wrong-way vehicle. An alert portion may comprise an alert feature that is configured to alert drivers moving along the highway and onto the off-ramp that a wrong-way vehicle has been detected. This alert, such as flashing lights and a sign, for example, may slow vehicles moving onto the off-ramp, as a disabled vehicle may be stopped along the off-ramp, as a result of driving over the tire-rupture apparatus.

The controller may also send a signal to authorities when a wrong-way vehicle is detected. The location and time, as well as a photograph of the vehicle, driver or license tag may be provided to the authorities. The authorities may then proceed quickly to the highway or off-ramp to prevent an accident. In addition, the wrong-way driver may be impaired and a picture of the vehicle or license tag may enable authorities to find and apprehend these drivers that quickly stop and turn around before proceeding over the tire puncture apparatus.

An exemplary disabling portion comprises a rupture plate that pivots up from a down and latched position to expose a plurality of rupture portions or surfaces for puncturing and rupturing tires. The rupture end of the rupture plate pivots up to a rupture height to enable the rupture portions to engage with a tire and rip the tire as it moves over the rupture plate. The rupture height of the rupture plate may be about 50 mm or more, about 75 mm or more about 100 mm or less, about 150 mm or less and any range between and including the heights provided. The activated height of the rupture end of the rupture plate may be kept below some nominal value to prevent impacting spoilers or other parts of a low-riding vehicle. An exemplary rupture plate is a single plate that extends is actuated as a single rigid plate. An exemplary rupture plate rotates about a plate-pivot that is recessed from the plane of the off-ramp. An exemplary rupture plate has a recessed portion at the rupture end when in an up and activated position. This recessed portion is a portion of the rupture plate that is within the rupture enclosure and prevents the rupture plate from sliding or moving out from the rupture enclosure. A recessed portion may be about 100 mm or less, about 50 mm or less, about 25 mm or less, about 15 mm or less and any range between and including the recessed dimensions provided.

An exemplary tire rupture plate may comprise a plurality of plates and stiffeners to produce a rigid plate that can withstand the force of heavy vehicles driving thereover. An exemplary tire rupture plate may comprise a top plate, a front stiffener, a back stiffener, and a plurality of stiffeners that run from the front to the back of the rupture plate. A plurality of rupture portions may be configured on the rupture end of the rupture plate and comprise a sharp edge that will rupture a tire when in an up and activated position and when the vehicle is moving in the wrong direction along the off-ramp. The rupture portions edge may extend along the thickness of the rupture plate.

An exemplary tire rupture apparatus extends substantially across the entire roadway, or off-ramp wherein a vehicle cannot pass without running over the rupture plate with at least two tires. A tire rupture apparatus or rupture plate may have a width that extends about 75% of the roadway width or more, preferably about 85% of the roadway width or more, and even more preferably about 95% of the roadway width or more. A tire rupture apparatus or rupture plate may have a length that is about 8 ft or more, about 10 ft or more, or about 12 feet or more.

An exemplary rupture plate may have a length that enables the rupture plate to pivot up to a rupture height at an angle that is about 20 degrees or less, and preferably less than about 15 degrees and even more preferably, about 10 degrees or less. This shallow angle will reduce impact loads on the rupture plate, rupture-pivot when a vehicle travels over the rupture plate in an activated and up position. Therefore, the rupture plate may have a length, or distance from the pivot end to the rupture end that is about five times or more greater than the rupture height, or about six times or more greater than the rupture height, or about eight times or more greater than the rupture height, or about ten times or more greater than the rupture height and any range between and including the lengths provided. For example, a rupture plate may have a rupture height of about 100 mm, or four inches and the length of the rupture plate may be about 609 mm, or 24 inches, a ratio of more than 6 to 1. This produces a rupture angle of less than about 10 degrees.

An exemplary rupture plate is actuated up to a rupture position by an actuator comprising a spring to force the rupture plate up and a latch. The latch engages with a latch-coupler of the rupture plate to keep the rupture plate retained in a down and latched position. When a wrong-way vehicle is detected a latch release feature, such as a solenoid, disengages the latch and latch-coupler and allows the spring or plurality of springs to force the rupture plate up. The latch may be configured to rotate about a latch-pivot and the solenoid may move the latch to disengage the latch and latch-coupler. Alternatively, the latch release feature may move the latch coupler, which may be on a hinge or pivot, to disengage the latch and the latch-coupler. An exemplary actuator comprises a spring or springs that are coupled with the rupture plate, wherein the spring forces a plate, cap and/or cover up which forces the rupture plate up.

A wrong-way vehicle prevention system may comprise a defect alert system, comprising one or more defect sensor that are activated in the event that one or more features is not functioning properly. In the event that a defect sensor detects a fault, an alert may be sent to authorities to enable quick repair or resetting of the system. For example, if power from an integral power supply drops below a threshold level, an alert may be sent to authorities and the system may be checked, and a battery may be replaced and/or a solar power generator.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
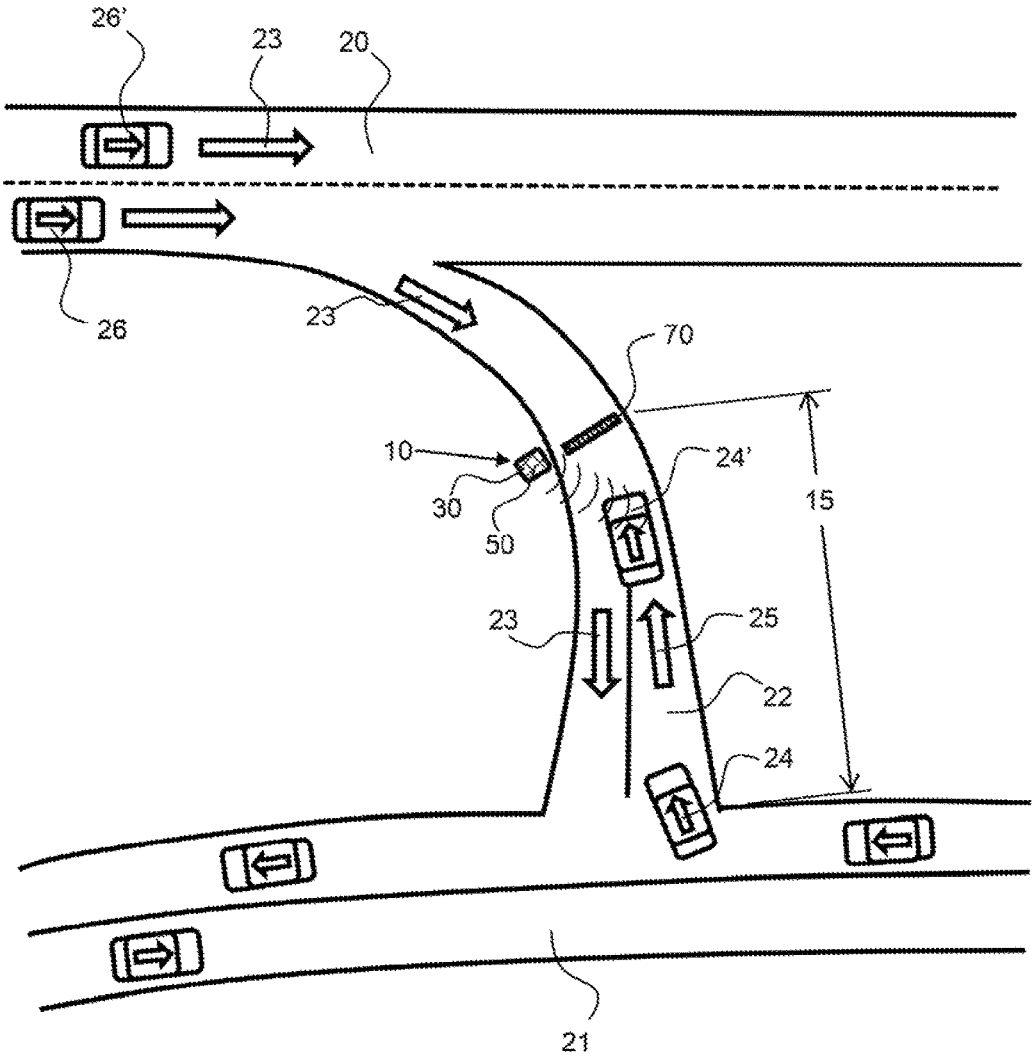
FIG. 1 shows a diagram of an exemplary wrong-way vehicle prevention system located proximal to a highway on an off-ramp.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

DEFINITIONS

Disabling a vehicle, as used herein, means that at least one or more of a vehicle's tires are ruptured and preferably two or more are ruptured.

Figure 2:
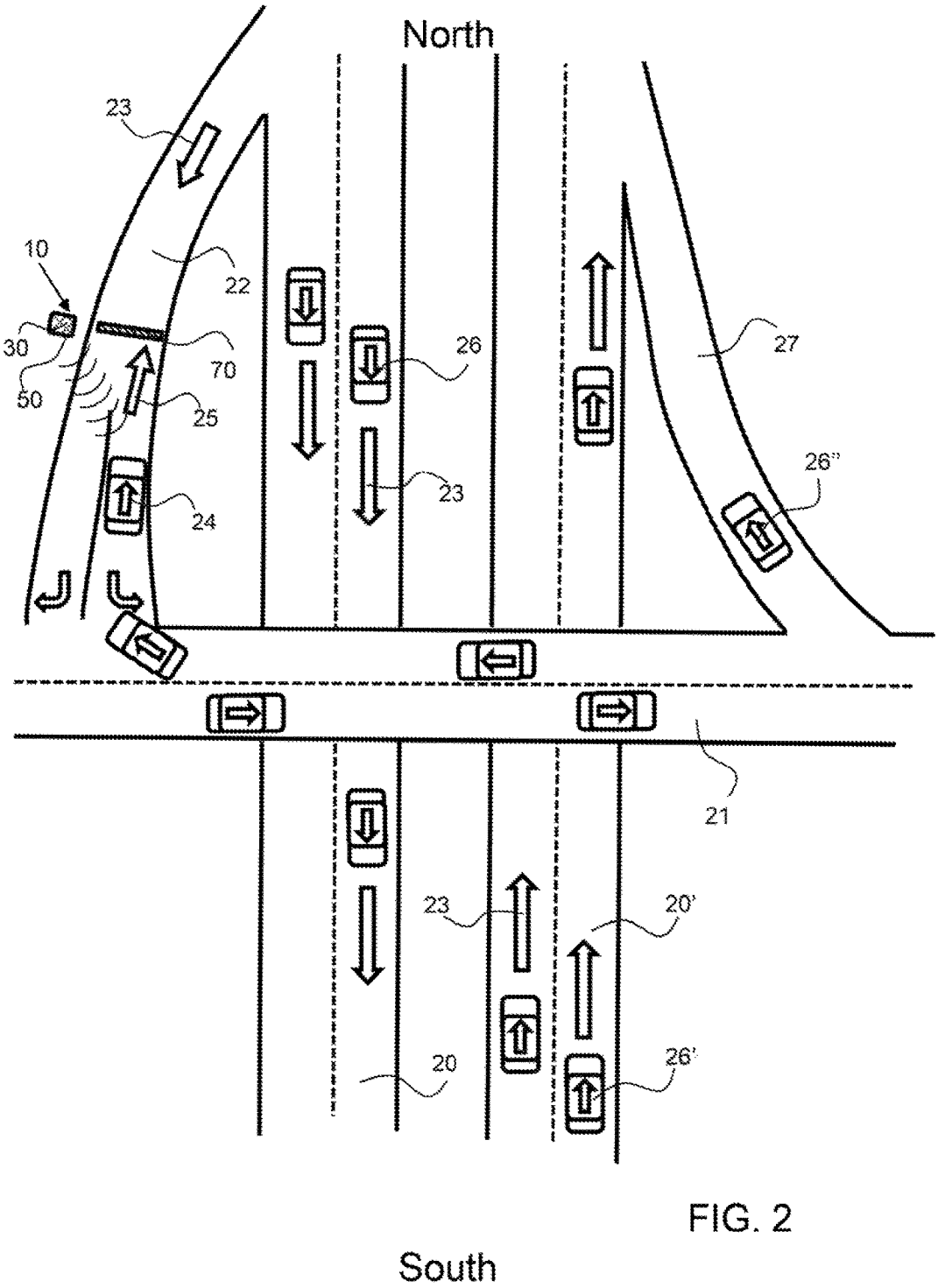
FIG. 2 shows a diagram of an exemplary wrong-way vehicle prevention system located on an off-ramp.

Referring to FIGS. 1 and 2, an exemplary wrong-way vehicle prevention system 10 comprises a tire rupture apparatus located in an off-ramp 22 and an alert portion 30, having a sensor 50 to detect an oncoming wrong-way vehicle. The tire rupture apparatus 70 is configured across the width of the off-ramp and preferably between the highway and where the off-ramp widens to provide multiple lanes, as shown. Off-ramps are typically narrow proximal to the highway 20 and may flare out to provide additional lanes for turning onto a feed roadway 21. For this reason, it may be desirable to locate the wrong-way vehicle prevention system proximal to the highway or at least where the off-ramp narrows to a single lane. An exemplary tire rupture apparatus may be configured an offset distance 15 from a feed roadway 21, which may be about 30 m or more, about 40 meters or more, about 60 m or more, about 75 m or more, or no more than about 100 m, and any range between and including the offset distances provided. The vehicles 26, 26' on the highway 20 are moving in the correct direction 23, as indicated by the bold arrow. A wrong-way vehicle 24 has turned from a feed roadway 21 onto the off-ramp 22 and is moving in a wrong-way direction 25, as indicated by the bold arrow on the off-ramp. The wrong-way vehicle 24' proceeds down the off-ramp and the sensor 50 detects the wrong-way vehicle and provides an alert, through the alert portion 30, to the wrong-way driver. An alert may be alert lights, such as blue and/or white lights that may flash. The driver of the wrong-way vehicle may stop and turn around when seeing the alert of proceeding on the off-ramp the wrong way. If the wrong-way vehicle continues along the off-ramp in the wrong direction, the tire rupture apparatus 70 is activated and one or more tires of the wrong-way vehicle will be ruptured if the wrong-way vehicle proceeds over the rupture apparatus.

As shown in FIG. 2, both sides of a highway 20, 20' are shown along with an off-ramp 22 and an on-ramp 27. Again, a wrong-way vehicle 24 is shown turning onto an off-ramp and proceeds in the wrong direction 25 on the off-ramp. The exemplary wrong-way vehicle prevention system 10 is configured on the off-ramp where it is narrow to allow a single car to pass and the rupture portion extends substantially across the width of the off-ramp.

Figure 3:
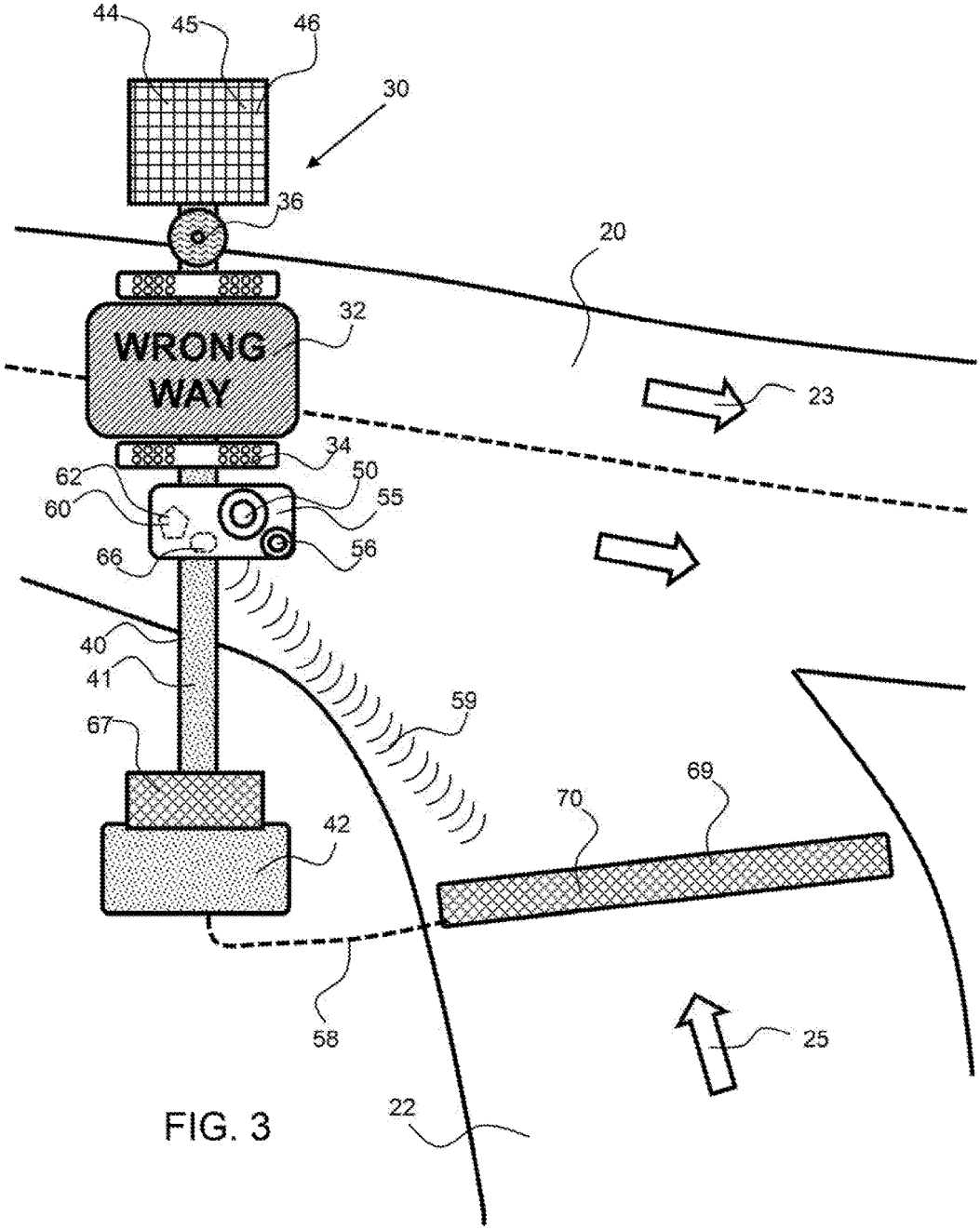
FIG. 3 shows an exemplary wrong-way vehicle prevention system having an alert portion to alert drivers proceeding on an off-ramp in the wrong direction.
Figure 4:
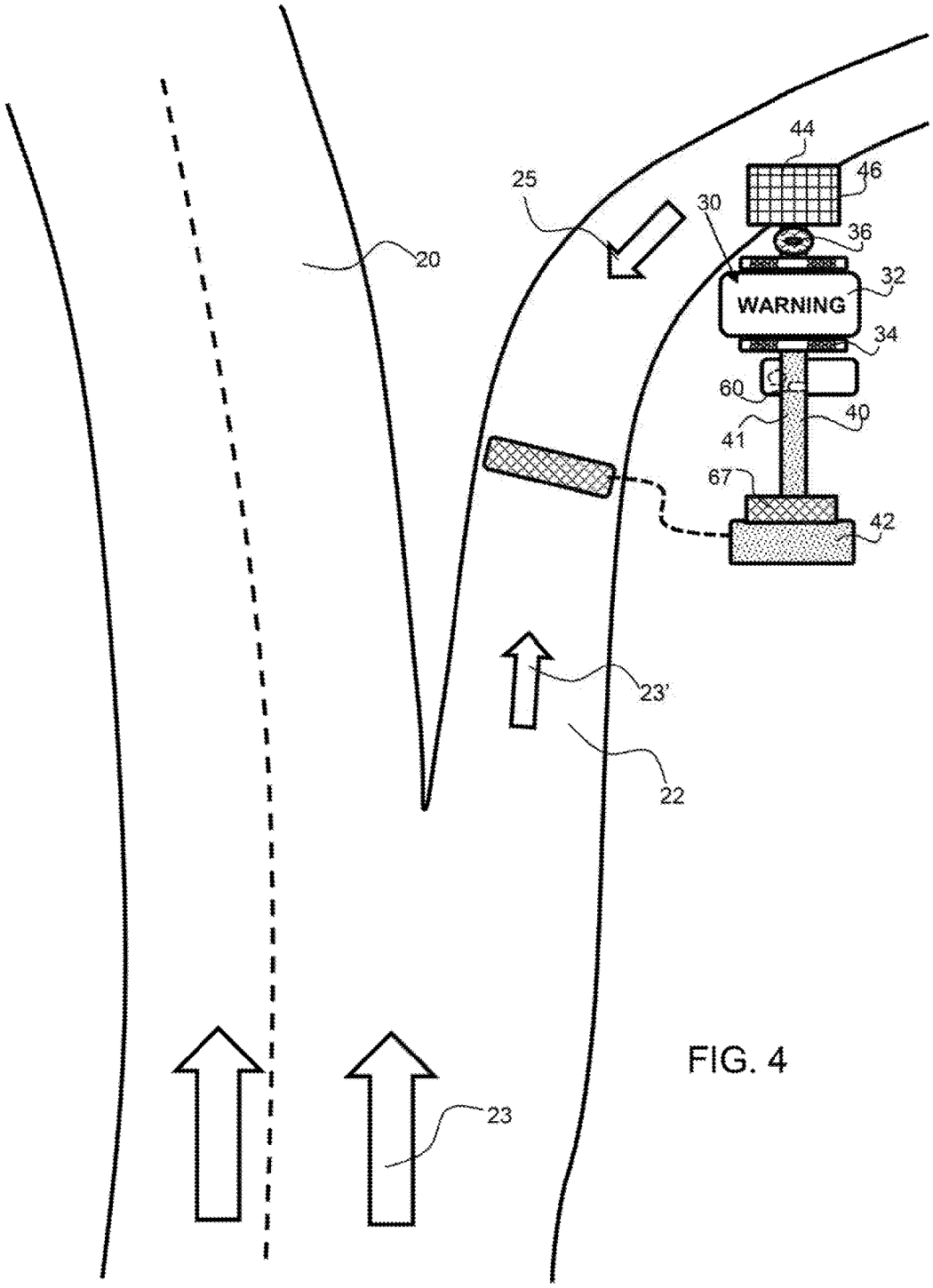
FIG. 4 shows an exemplary wrong-way vehicle prevention system having an alert portion to alert drivers exiting off of the highway onto an on-ramp that a wrong-way vehicle is detected.

As shown in FIG. 3, an exemplary wrong-way vehicle prevention system has an alert portion 30, a sensor 50 and a disabling portion 69 comprising a tire rupture apparatus 70 that extends substantially across the off-ramp 22. The alert portion produces an alert when a wrong-way vehicle is detected by the sensor 50. An alert may include a sign 32, and this sign may be illuminated by a light or lights 34 that flash to draw a driver's attention to the sign. An alert may also include an audible alert feature 36, such as a speaker that produces an audible alert, such as a siren, a horn or alert message such as "STOP . . . WRONG WAY", for example. The tire rupture apparatus may be activated when the sensor detects a wrong-way vehicle. A controller 60 may receive input from the sensor and activate the various alert features and the tire rupture apparatus when a wrong-way vehicle is detected. The alert portion may also comprise a sign to warn drivers exiting the highway of a wrong-way vehicle and this sign may be illuminated in the event that a wrong way vehicle is detected, as shown in FIG. 4. A connection line 58 may extend between alert portion, controller or sensor and the tire rupture apparatus to control the deployment of the tire rupture apparatus when a wrong-way vehicle is detected. A wireless signal 59 may also be emitted by the controller, such as from a wireless signal transmitter 66 to activate the tire rupture apparatus. A controller may comprise a microprocessor 62 to control the functions of the wrong-way vehicle prevention system. The exemplary wrong-way vehicle prevention system may be powered by a power supply 44, and preferably by an integral power supply, such as a solar power generator 45 employing photovoltaic cells 46. Power generated by the solar power generator may be stored in a battery 67. An integral power supply is a power supply that produces power without connection to a power grid, such as a solar power generators, wind power generators, fuel cells, batteries, and the like. In this way, the exemplary wrong-way vehicle prevention system does not require any additional power lines and may be installed in remote areas. The alert portion 30 of the wrong-way vehicle prevention system is configured on a support 40, such as a post 41 secured to a base 42.

The controller 60 may send a wireless signal to authorities when a wrong-way driver is detected by the sensor. The signal may provide the location of the detected wrong-way vehicle, an image of the wrong-way vehicle, driver or license plate, and may automatically activate other warnings to motorist on the highway put in harm's way by wrong-way vehicle. Authorities may quickly proceed to the highway to slow traffic and prevent a head on collision. An exemplary authority alert feature 55 comprises a camera 56 coupled to the alert portion that take images of the vehicle, driver and/or the vehicles license tag and these images may be stored in the alert portion and/or sent to authorities by the wireless signal transmitter along with the location and time. An exemplary authority alert feature may send just the location and time of the detection of the wrong way driver to authorities utilizing the wireless signal transmitter. In addition, authorities may reset the tire rupture apparatus after it has been deployed. This may be done manually or by simply driving over the tire rupture apparatus in a correct direction.

As shown in FIG. 4, an exemplary wrong-way vehicle prevention system has an alert portion 30 with an alert feature for alerting driver's exiting the highway onto an off-ramp 22 that a wrong-way driver has been detected. Again, the alert feature may be an audible alert, a sign, or one or more lights. A sign may be illuminated only when a wrong-way vehicle is detected.

Figure 5:
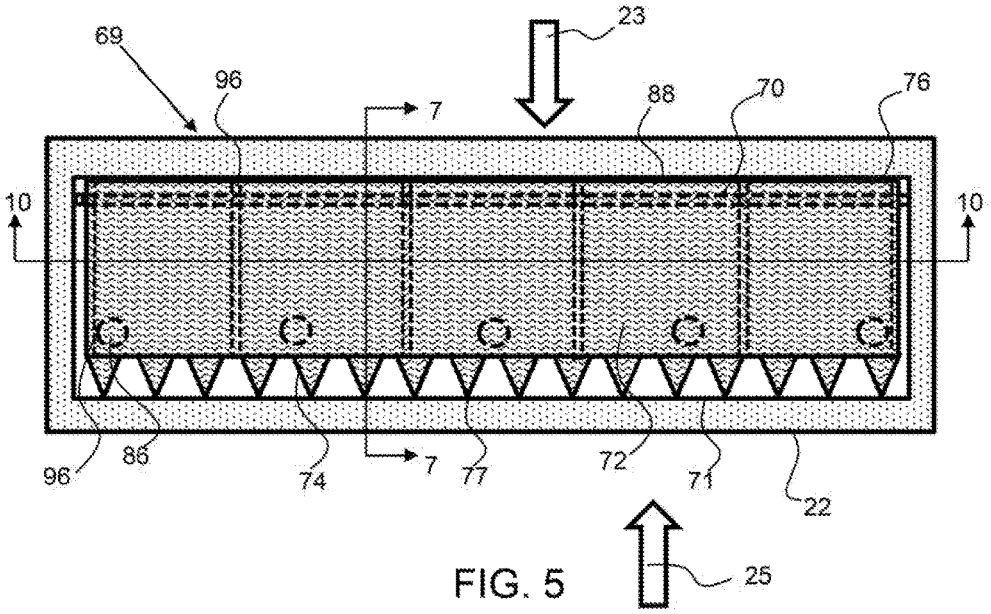
FIG. 5 shows a top view of an exemplary tire rupture apparatus.
Figure 6:
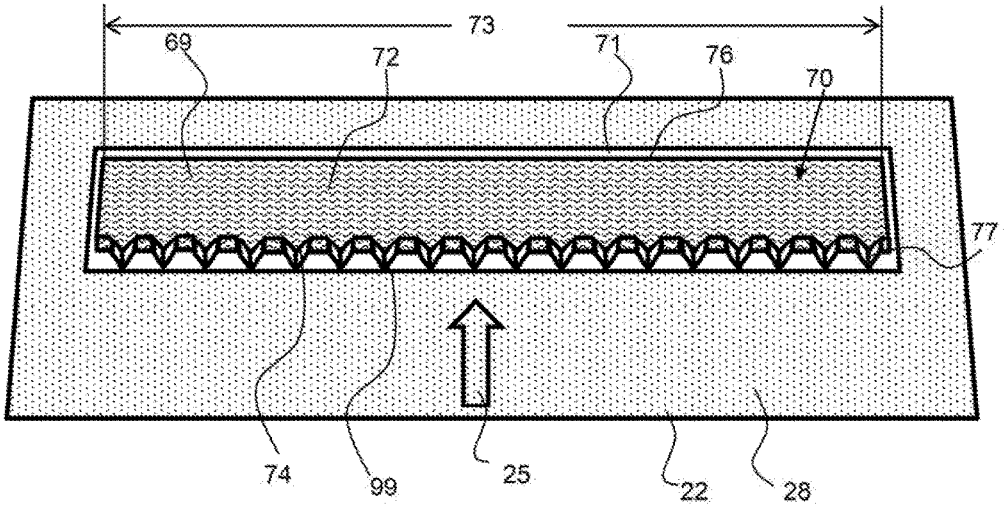
FIG. 6 show s perspective view of an exemplary tire rupture apparatus.
Figure 7:
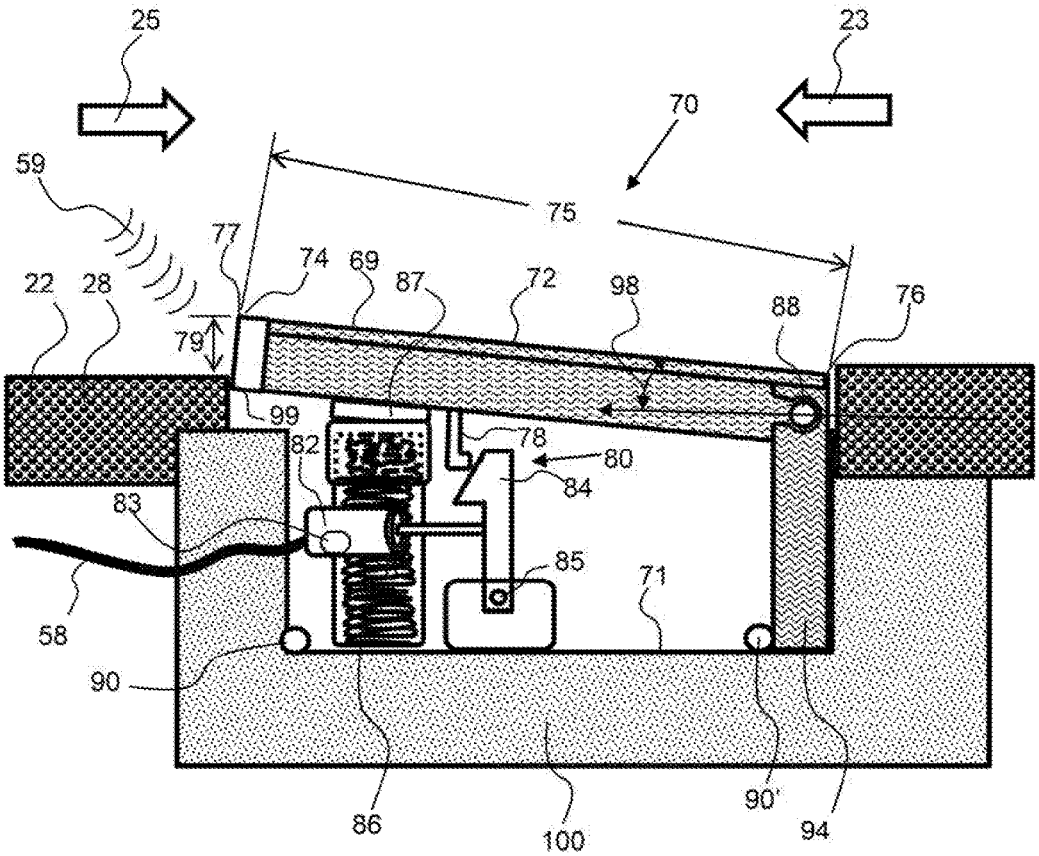
FIG. 7 shows a cross-sectional view of the exemplary tire rupture apparatus shown in FIG. 5, along line 7-7, with the rupture plate in an up position.

Referring now to FIGS. 5 to 9, an exemplary disabling portion 69 of the wrong-way vehicle prevention system comprises a tire rupture apparatus 70. An exemplary tire rupture apparatus comprises a tire rupture plate 72 that moves from a down position, or latched position, wherein the plate is substantially parallel with the off-ramp roadway surface to an up, or activated position, wherein the rupture plate is pivoted up about a pivot end 76, by an actuator 80, to elevate the rupture end 74 up from the off-ramp roadway surface. As shown in FIG. 5, the rupture plate comprises a plurality of rupture portions 77 that are sharp and configured to rupture a vehicle tire when moving over the tire rupture apparatus in a wrong direction 25. The rupture plate is a unitary plate that is rigid and may comprises a top-plate and a plurality of stiffeners to enable large vehicles to drive over thereover. A plurality of actuators, comprising springs 86 are configured across the width of the disabling portion to provide a uniform and effective lift of the rupture plate. In addition, a plurality of stiffeners 96 are shown extending from the pivot end 76 to the rupture end 74 of the rupture plate. As shown in FIGS. 6 and 7, the rupture plate 72 is in an up or activated position with the rupture plate pivoted up about a plate-pivot 88 and the rupture portions 77 elevated up from the pavement 28 of the off-ramp 22 by an up-distance 79 that is sufficient to rupture tires. The rupture portions have an edge that extends down along the thickness of the rupture plate. Note that there is a recessed portion 99 of the rupture end 74 of the rupture plate 72 that prevents the rupture plate from being dislodged when in an up position. A vehicle driving over the tire rupture apparatus in the correct direction would not dislodge the rupture plate as it is retained in position by this recessed portion in the rupture enclosure 71. The rupture enclosure 100 is an enclosure, such as a metal box that is inserted into the off-ramp to house the tire rupture apparatus 70. The tire rupture enclosure may have one or more drains 90, 90' to allow any collected water to drain therefrom, as shown in FIG. 7. The rupture plate has a length 75 as shown in FIG. 7 and width 73 as shown in FIG. 6.

Figure 8:
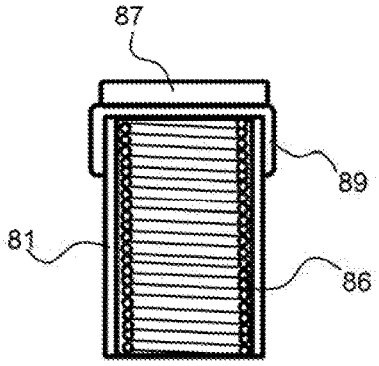
FIG. 8 shows a cross-section view of an exemplary actuator comprising a spring in a spring enclosure and a spring cap over the top of spring that mates with an actuator portion.
Figure 9:
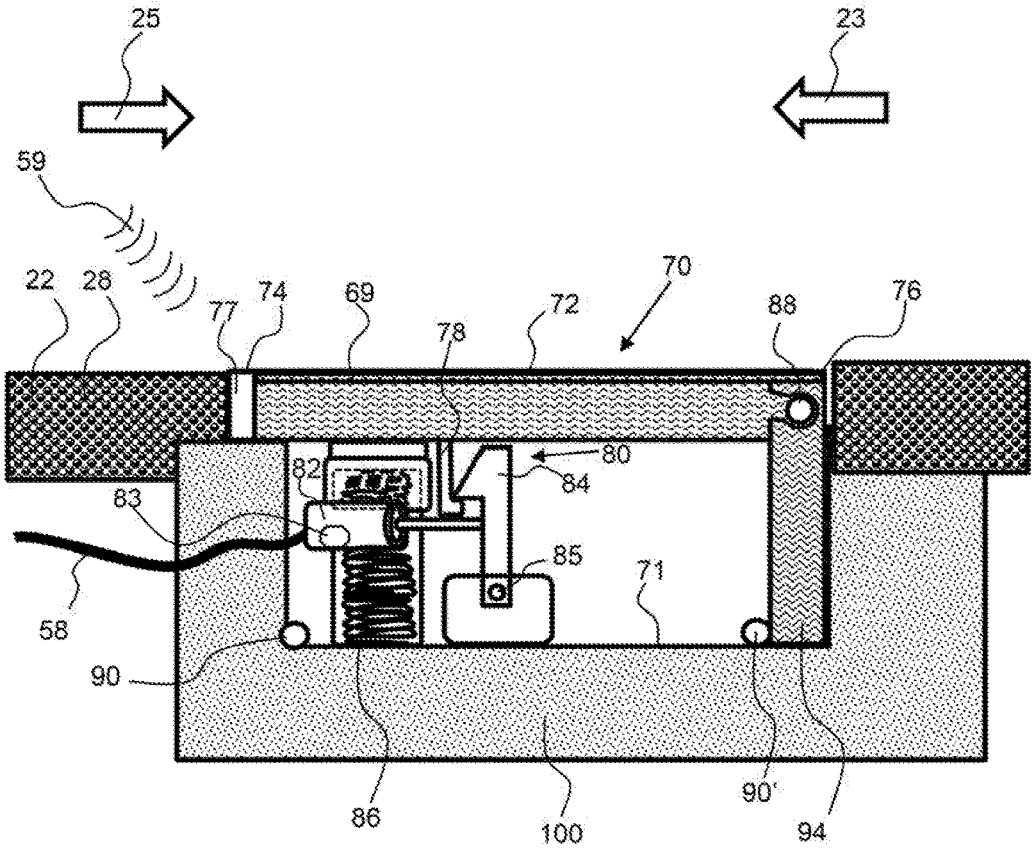
FIG. 9 shows a cross-sectional view of an exemplary tire rupture apparatus with the rupture plate in a down position.

As shown in FIG. 7 to 9, the rupture plate 72 is pushed up to an up position by an actuator 80 comprising an actuator portion 87 that is coupled between the rupture plate 72 and a spring 86. As detailed in FIG. 8, the spring 86 is configured in a spring enclosure 81 and a spring-cap 89 extends over the enclosure to prevent debris from getting into the spring enclosure. The spring cap slides up and down along the spring enclosure to allow the spring to force the rupture plate up, when the latch is released. The spring cap is coupled with an actuator portion 87, which may be a plate that is coupled with or affixed to the rupture plate. The actuator further comprises a latch release feature 82, such as solenoid as shown, that releases the latch 84 by moving the latch about the latch-pivot 85 to enable the spring to force the rupture plate up about the plate pivot 88. The plate pivot is configured on the plate pivot support 94. A latch-coupler 78 engages with the latch 84 to secure the rupture plate in a down position and secure position, as shown in FIG. 9.

As shown in FIGS. 7 and 9, a connection line 58 extends from the latch release feature 82 to the controller (not shown). A wireless signal receiver 83 may receive a wireless signal 59 from the controller to activate the tire rupture apparatus. The signal may cause the solenoid to push the latch about the pivot to raise the rupture plate, as shown in FIG. 7. The rupture angle 98 is shown in FIG. 7 and is a shallow angle to prevent excessive forces on the rupture plate when vehicles drive thereover. The recessed portion 99, prevents the rupture plate from being dislodged. The plate pivot 88, such as a rod, is supported within the rupture enclosure 71 by a plate-pivot support. The plate pivot support may have an aperture or slot for receiving the plate pivot, or pivot rod.

Figure 10:
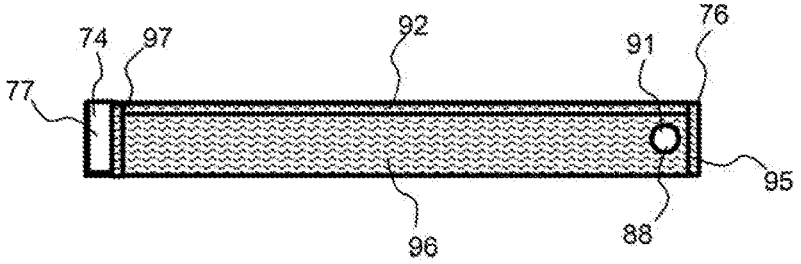
FIG. 10 shows a side view of an exemplary rupture plate comprising a rupture point, a top plate, and a stiffener.
Figure 11:
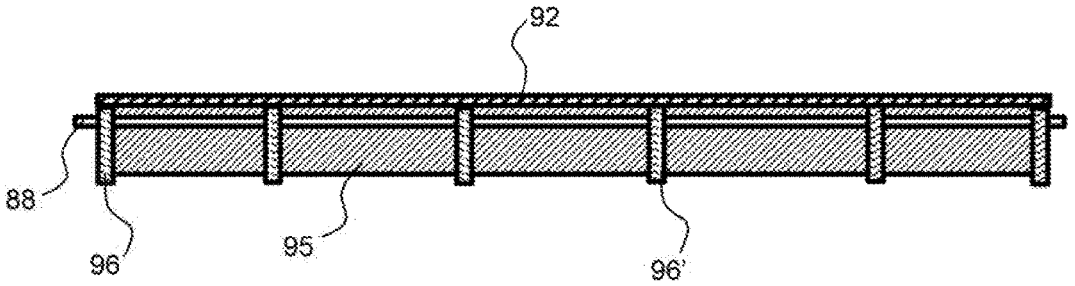
FIG. 11 shows a cross-sectional view of the exemplary tire rupture plate shown in FIG. 5, along line 10-10 having 6 stiffeners along the length of the rupture plate.

As shown in FIGS. 10 and 11, a rupture plate may comprise a top-plate portion 92, a plurality of stiffeners 96 that extend across the width and/or length of the tire-rupture plate and under a top-plate. A rupture plate may comprise a front stiffener 97 that extends along the rupture end 74 of the rupture plate. The rupture portion 77 may be attached to the front-stiffener. A rupture plate may comprise a back-stiffener 95, or plate that extends along the pivot end 76 of the rupture plate. Stiffeners may comprise a plate pivot aperture 91 for a plate pivot 88, such as a rod to extend therethrough.

Figure 12:
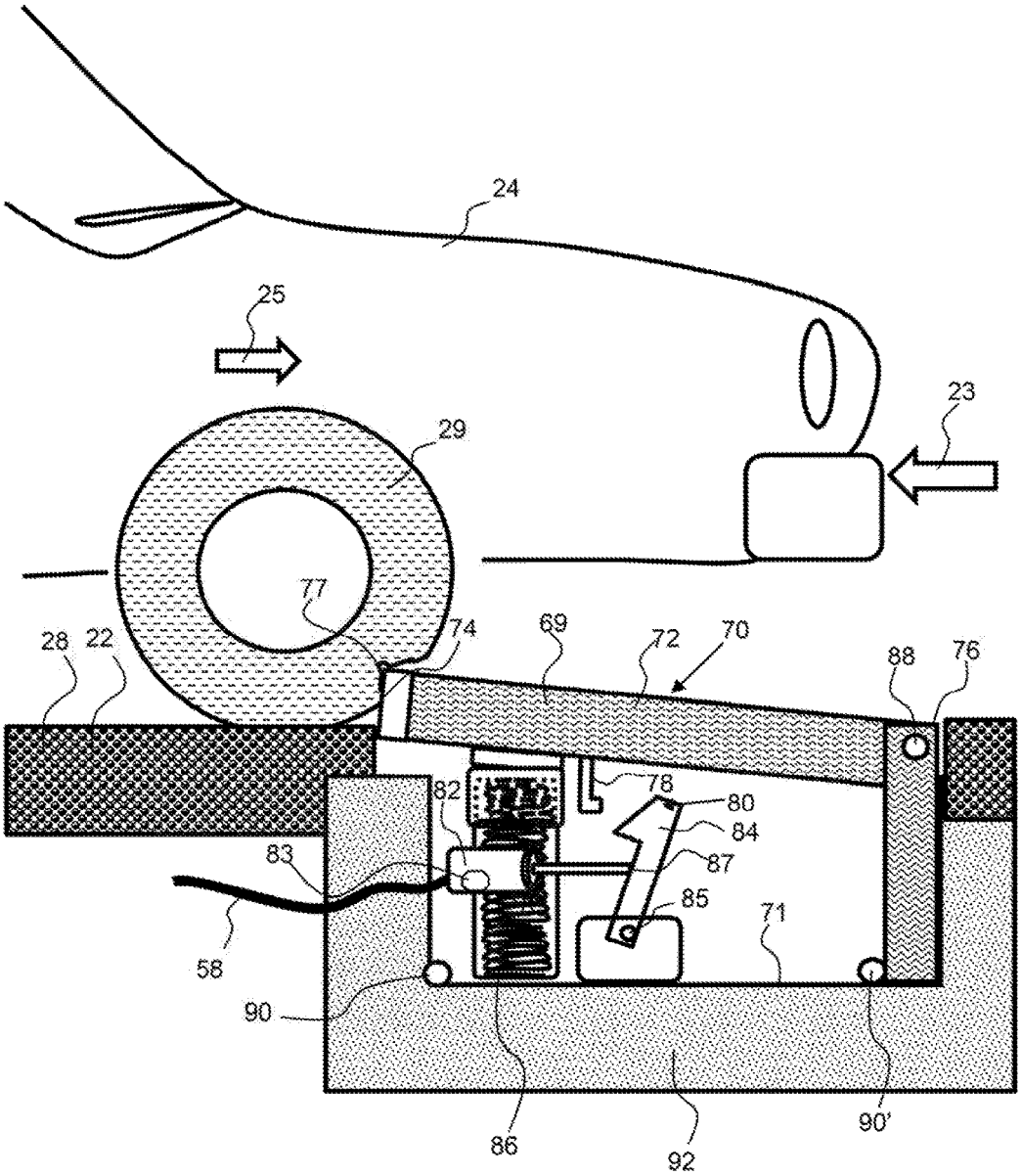
FIG. 12 shows a wrong-way vehicle driving over an exemplary tire rupture apparatus and the tire being ruptured by the rupture point of the rupture plate.

As shown in FIG. 12, the rupture plate 72 is in an up or activated position and a wrong-way vehicle is traveling over the tire rupture apparatus 70 in the wrong direction 25. The wrong-way vehicle 24 is moving over the tire rupture apparatus in and the tires 29 are being ruptured to disable the vehicle. The rupture end 74 of the rupture plate 72 is rupturing the tire and a recessed portion of the rupture end is within the rupture enclosure 71. The rupture plate 72 is rotated up about the plate-pivot 88 by the actuator 80 and particularly the spring 86. The latch release feature 82, or solenoid, has moved the latch to disengage the latch from the latch-coupler 78. A latch may rotate about a latch pivot 85, as shown to disengage from the latch coupler. Again, the latch release feature may have an activation time, such as about 3 second or more, 5 seconds or more or event 10 second or more and any range between and including these activation times values, before the latch release feature disengages, or the actuator portion is retrieved by the solenoid, for example. This activation time may ensure that the rupture plate stays rotated up as the front wheels pass over the rupture plate to ensure that the back wheels of the wrong-way vehicle are also ruptured. After the activation time has lapsed, a vehicle moving over the rupture plate in the correct direction will push the rupture plate down and it will automatically be re-latched in a down and latched position, as shown in FIG. 13.

Figure 13:
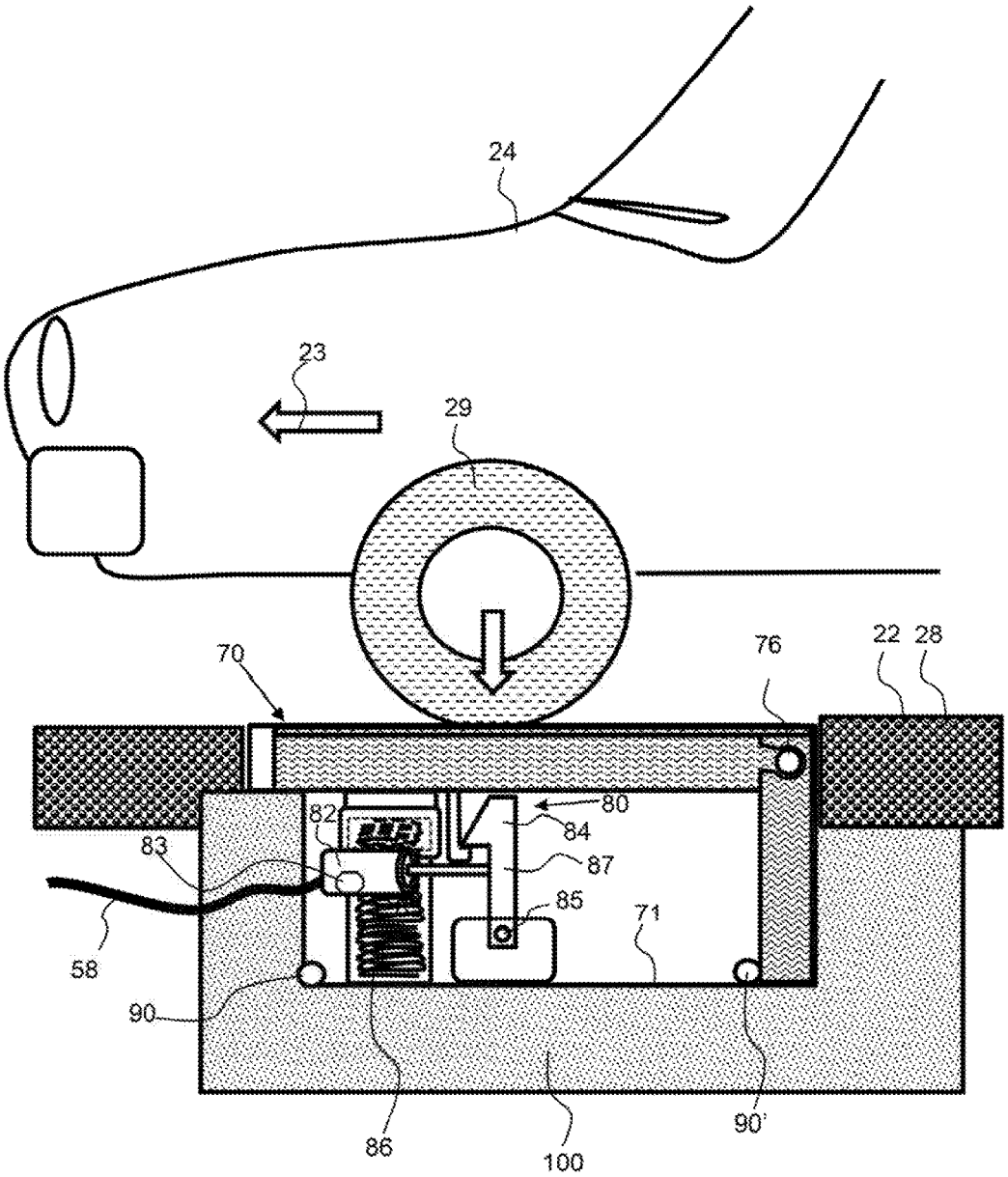
FIG. 13 shows the rupture plate being returned to a down and latched position by a vehicle moving over the tire rupture apparatus in a correct direction.

As shown in FIG. 13, the rupture plate 72 is returned to a down and latched position by a vehicle 26 moving over the tire rupture apparatus in a correct direction 23. The tires of the vehicle are not damage by the tire rupture apparatus. The rupture end 74 of the rupture plate 72 is forced down about the plate-pivot 88 by the weight of the vehicle. The latch-coupler 78 rotates the latch about the latch-pivot 85 to engage the latch 84 with the latch-coupler. A sign on the alert portion may warn drivers driving from the highway onto the off-ramp to slow down as they pass over the tire rupture apparatus. As the public becomes aware of these devices they will understand when a cation or warning sign is provided at an off-ramp.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of preventing a wrong-way vehicle comprising the steps of:

a) providing a wrong-way vehicle prevention system comprising:
  i) sensor for sensing wrong-way vehicle;
  ii) a disabling portion comprising:
    a tire rupture apparatus comprising:
      a rupture plate comprising:
      a rupture end comprising a plurality of rupture portions; and
      a pivot end coupled with a plate-pivot;
    an actuator comprising:
      a spring;
      a latch; and
      a latch release feature;

b) a controller that activates the disabling portion when said wrong-way vehicle is detected by the sensor;

c) monitoring an off-ramp with said sensor;

d) when said sensor detects a wrong-way vehicle, the controller sends an activation signal to the disabling portion, whereby the actuator activates the latch release feature to release the latch and enable the spring to force the rupture plate to pivot about the plate-pivot to an up position, wherein the plurality of rupture portions are extended up above a roadway surface to rupture one or more tires of said wrong-way vehicle.

2. The method of preventing a wrong-way vehicle of claim 1, wherein the rupture plate extends substantially across the off-ramp, wherein the rupture plate has a width that extends at least 75% of a width of the off-ramp.

3. The method of preventing a wrong-way vehicle of claim 1, wherein the rupture plate is a one-piece integral plate.

4. The method of preventing a wrong-way vehicle of claim 1, wherein the latch release feature is a solenoid.

5. The method of preventing a wrong-way vehicle of claim 1, wherein the latch is coupled to a latch-pivot, and wherein the latch release feature rotates the latch about the latch-pivot to disengage the latch and allow the spring to force the rupture plate to an up position.

6. The method of preventing a wrong-way vehicle of claim 1, further comprising the step of returning the rupture plate to a down and latched position when a vehicle moving in a correct direction drives over the tire rupture apparatus.

7. The method of preventing a wrong-way vehicle of claim 1, further comprising an integral power supply comprising a solar power generator comprising a photovoltaic cell.

8. The method of preventing a wrong-way vehicle of claim 1, further comprising an alert portion comprising an alert light that is activated by the controller when said wrong-way vehicle is detected by the sensor.

9. The method of preventing a wrong-way vehicle of claim 1, further comprising an alert portion comprising an audible alert feature that is activated by the controller when said wrong-way vehicle is detected by the sensor to produce an audible alert.

10. The method of preventing a wrong-way vehicle of claim 1, wherein the alert portion is configured within 20 yards of the disabling portion to produce an integral wrong-way vehicle prevention system.

11. The method of preventing a wrong-way vehicle of claim 1, comprising a connection line between the controller and the disabling portion to activate the tire rupture apparatus from a latched position to an up position when said wrong-way vehicle is detected by the sensor.

12. The method of preventing a wrong-way vehicle of claim 1, comprising a wireless signal transmitter coupled with the sensor and a wireless signal receiver coupled with the actuator, wherein said wireless signal transmitter transmits a wireless signal to the wireless signal receiver when said wrong-way vehicle is detected by the sensor to activate the tire rupture apparatus from a latched position to an up position.

13. The method of preventing a wrong-way vehicle of claim 1, further comprising an authority alert feature comprising a camera that is controlled by the controller to take an image when a wrong-way vehicle is detected by the sensor; and further comprising the step of sending said image to an authority through a wireless signal transmitter.

14. The method of preventing a wrong-way vehicle of claim 13, wherein the image includes the wrong-way vehicle detected by the sensor.

15. The method of preventing a wrong-way vehicle of claim 13, wherein the image includes a driver of the wrong-way vehicle detected by the sensor.

16. The method of preventing a wrong-way vehicle of claim 13, wherein the image includes a license plate of the wrong-way vehicle detected by the sensor.

17. The method of preventing a wrong-way vehicle of claim 1, wherein the alert portion is configured on a single support.

18. The method of preventing a wrong-way vehicle of claim 17, wherein the alert portion comprises:

a) a sign;

b) an alert light;

c) an integral power supply; and d) said sensor.

19. The method of preventing a wrong-way vehicle of claim 18, wherein the support comprises a post.

20. A method of preventing a wrong-way vehicle comprising the steps of:

a) providing a wrong-way vehicle prevention system comprising:

i) sensor for sensing wrong-way vehicle;

ii) a disabling portion comprising:

a tire rupture apparatus comprising:

a rupture plate that is a one-piece integral plate comprising:

rupture end comprising a plurality of rupture portions; and a pivot end coupled with a plate-pivot;

an actuator comprising:

a spring;

a latch; and a latch release feature;

iii) a controller that activates the disabling portion when said wrong-way vehicle is detected by the sensor;

iv) an alert portion comprising an alert light feature and wherein said alert light is activated by the controller when said sensor detects a wrong-way vehicle to produce an alert light;

v) an authority alert feature comprising a camera that is controlled by the controller to take an image when a wrong-way vehicle is detected by the sensor;

b) monitoring an off-ramp with said sensor;

c) when said sensor detects a wrong-way vehicle activating the alert light feature;

d) when said sensor detects a wrong-way vehicle sending said image from taken by the camera to an authority;

e) when said sensor detects a wrong-way vehicle, the controller sends an activation signal to the disabling portion, whereby the actuator activates the latch release feature to release the latch and enable the spring to force the rupture plate to pivot about the plate-pivot to an up position, wherein the plurality of rupture portions are extended up above a roadway surface to rupture one or more tires of said wrong-way vehicle;

wherein the rupture plate extends substantially across the off-ramp, wherein the rupture plate has a width that extends at least 75% of a width of the off-ramp.

* * * * *